US007250032B2

(12) United States Patent
Fink

(10) Patent No.: US 7,250,032 B2
(45) Date of Patent: Jul. 31, 2007

(54) DEVICE AND ASSOCIATED SYSTEM FOR MOBILIZATION OF THE BACK

(76) Inventor: Thomas Andrew Fink, 3136 Indian Ripple Rd., Dayton, OH (US) 45440

( * ) Notice: Subject to any disclaimer, the term of this patent is extended or adjusted under 35 U.S.C. 154(b) by 0 days.

(21) Appl. No.: 11/323,492

(22) Filed: Dec. 31, 2005

(65) Prior Publication Data

US 2006/0149174 A1 Jul. 6, 2006

Related U.S. Application Data

(60) Provisional application No. 60/640,618, filed on Dec. 31, 2004.

(51) Int. Cl.
*A61H 15/00* (2006.01)

(52) U.S. Cl. ..... 601/118; 601/121

(58) Field of Classification Search ..... 601/121–122, 601/118; 602/13; 128/DIG. 20
See application file for complete search history.

(56) References Cited

U.S. PATENT DOCUMENTS

| | | | | |
|---|---|---|---|---|
| 2,221,785 | A | 11/1940 | Douglas | |
| 3,616,794 | A | 11/1971 | Gromata | |
| 3,705,579 | A * | 12/1972 | Morini et al. | 601/121 |
| 3,750,654 | A | 8/1973 | Shui | |
| 4,021,035 | A * | 5/1977 | O'Hara | 482/88 |
| D264,625 | S | 5/1982 | Shui | |
| 4,785,800 | A | 11/1988 | Stilson | |
| 4,807,603 | A | 2/1989 | Yasui | |
| 4,945,900 | A | 8/1990 | Masuda | |
| 6,129,687 | A | 10/2000 | Powell et al. | |
| 6,375,601 | B1 * | 4/2002 | Johnson | 482/142 |
| D492,791 | S | 7/2004 | Alexander | |

* cited by examiner

*Primary Examiner*—Michael A. Brown

(57) ABSTRACT

A device 100 and associated system for facilitating convenient and effective back mobilization of a clothed person is disclosed. The device has a substantially cylindrical body 102 having two ends 104 and two cylindrical, radial surfaces 106, wherein the cylindrical, radial surfaces make substantially smooth transitions 108 into the ends proximate the cylindrical, radial surfaces; and a channel of reduced radius 110 approximately centered between the ends of the cylindrical body, wherein the cylindrical, radial surfaces make substantially smooth transitions 112 into the channel proximate the cylindrical, radial surfaces. The system further includes a clothing retainer 200 for retaining clothing proximate the body of the person. The person is able to mobilize the back while moving the back along the cylindrical, radial surfaces of the device causing the device to roll while the clothing retainer keeps the clothing from underneath the rolling device as it rolls.

7 Claims, 7 Drawing Sheets

DEVICE AND ASSOCIATED SYSTEM FOR MOBILIZATION OF THE BACK

CROSS-REFERENCE TO RELATED APPLICATIONS

This application claims the benefit of provisional patent application No. 60/640,618 filed Dec. 31, 2004 by the present inventor.

BACKGROUND

Many people experience back pain. For some, this back pain is a temporary condition is due in part to a lack of mobilization of the back vertebrae and the associated muscles of the back. Those who suffer this type of back pain often describe the condition as stiffness in their back.

Many find relief from this condition by way of therapies such as chiropractic therapies, and massage therapies. After therapy, patients often feel an instant decrease in back stiffness (e.g., an instant improvement in back mobility), and a corresponding decrease in back pain. Many find this condition to be recurring because of work related activities and the like. Therapy is often repeated as needed by the patient.

Chiropractic therapies, massage therapies, and other therapies are not always conveniently available when needed and their costs can be prohibitive for some. Accordingly, several apparatus and devices have been offered to consumers for self-induced therapies or for therapies which can be applied by a non-professional person including many apparatus and devices designed for massaging the back. These devices include the following:

U.S. Pat. No. 2,221,785 by Douglas offers an apparatus having operating handles and a plurality of weights. U.S. Pat. No. 3,616,794 by Gromala offers an apparatus having a shaft with handgrips. U.S. Pat. No. 3,705,579 by Morini et al. offers a device having a sharp-edged narrowed-portion formed by two truncated cones and spherical ends. U.S. Pat. No. 3,750,654 by Shui offers a device having flared end portions. U.S. Pat. No. 4,785,800 by Stilson offers a device having spherical ends. U.S. Pat. No. 4,807,603 by Yasui offers a device having an elongated spherical shape with a sharp-edged groove and substantially sharp-edged ends. U.S. Pat. No. 4,945,900 by Masuda offers an apparatus having a longitudinal operating shaft. U.S. Pat. No. 6,129,687 by Powell et al. offers a device having two elongated spherical-shaped containers with protrusions. U.S. Pat. No. D264,625 by Shiu offers a device having two ends formed as elliptical bodies of revolution. U.S. Pat. No. D492,791 by Alexander offers a device having spherical ends.

The devices and apparatus cited above and other devices and apparatus currently known suffer from one or more shortcomings when used by a clothed person for the purpose of conveniently and effectively mobilizing his or her back from the top of the buttocks to the base of the neck. These shortcomings include creating creases and the like in clothing during use, catching and stretching of clothing during use, lack of adequate engagement of the back when used near the shoulders, lack of axial stability when used on common floor coverings, lack of roll path stability when used on common floor coverings, inability to effectively mobilize the back from the top of the buttocks to the base of the neck, excessive pressure on the back during use, applying high pressure directly to the spine and its associated soft tissues, rigid parts proximate and thus potentially contacting sensitive back areas, rigid edges that movably contact sensitive areas of the body at high pressures and without visibility during use, sharp edges that movably contact sensitive areas of the body at high pressures and without visibility during use, making necessary compromises to cater to multiple areas of the body or multiple purposes.

Therefore, for many sufferers of back stiffness, it is desirable to develop a system for back mobilization that conveniently and effectively mobilizes the back of a clothed person from the top of the buttocks to the base of the neck while overcoming the shortcomings inherent in current offerings.

SUMMARY

With the desire help of the many sufferers of back pain caused by lack of mobilization, I have invented an improved device and system for mobilization of the back. This invention was developed to meet many objectives including:

A). providing a device that does not create creases and the like in clothing during use;

B). providing a system that does not catch and stretch clothing during use;

C). providing a device that adequately engages the back when used near the shoulders;

D). providing a device that exhibits axial stability when used on common floor coverings;

E). providing a device that exhibits of roll path stability when used on common floor coverings;

F). providing a device that effectively mobilizes the back from the top of the buttocks to the base of the neck;

G). providing a device that eliminates excessive pressure on the back during use;

H). providing a device that does not apply high pressure directly to the spine and its associated soft tissues;

I). providing a device that has no rigid parts proximate and potentially contacting sensitive back areas;

J). providing a device that has no rigid edges potentially contacting sensitive back areas;

K). providing a device that has no sharp edges potentially contacting sensitive back areas;

L). providing a device that does not hinder its ability to conveniently and effectively mobilize the back by making necessary compromises to expand the usefulness of the device to multiple areas of the body or multiple purposes; and M). providing a device that can be initially manufactured using readily available, low-cost supplies which allows one to demonstrate commercial potential, thus increasing the likelihood of one gaining funding for molding costs and minimum order cost barriers.

The advantages offered from meeting each of these objectives along with other aspects and advantages of the present invention will be evident as details describing the present invention are presented here forth. In meeting each of these objectives to help the many sufferers of back pain caused by lack of mobilization, my development efforts led to a system for facilitating convenient and effective back mobilization of a clothed person. The system comprises a rolling means for mobilizing the back, and a clothing retainer means for retaining the clothing proximate the body of the person. The person is able to mobilize the back while moving the back along the rolling means causing the rolling means to roll while the retainer means keeps the clothing from underneath the rolling means as it rolls.

The present invention may also be embodied as a device for facilitating convenient and effective back mobilization of a clothed person. The device comprises a substantially cylindrical body having two ends and two cylindrical, radial surfaces, wherein the cylindrical, radial surfaces make substantially smooth transitions into the ends proximate the cylindrical, radial surfaces; and a channel of reduced radius approximately centered between the ends of the cylindrical body, wherein the cylindrical, radial surfaces make substantially smooth transitions into the channel proximate the cylindrical, radial surfaces.

The device has a cylinder length measured between the two ends and a cylinder diameter, wherein a ratio of the cylinder diameter to the cylinder length is preferably between approximately 0.5 and 3. The device is preferably constructed of plastic foam or flexible plastic inflatable with pressurized air.

Additionally, the present invention may be embodied as a system for facilitating convenient and effective back mobilization of a clothed person. The system comprises a device for facilitating convenient and effective back mobilization of a clothed person. The device comprises a substantially cylindrical body having two ends and two cylindrical, radial surfaces, wherein the cylindrical, radial surfaces make substantially smooth transitions into the ends proximate the cylindrical, radial surfaces; and a channel of reduced radius approximately centered between the ends of the cylindrical body, wherein the cylindrical, radial surfaces make substantially smooth transitions into the channel proximate the cylindrical, radial surfaces. The system further comprises a clothing retainer means for retaining the clothing proximate the body of the person. The person is able to mobilize the back while moving the back along the cylindrical, radial surfaces of the device causing the device to roll while the retainer means keeps the clothing from underneath the rolling device as it rolls.

The device has a cylinder length measured between the two ends and a cylinder diameter, wherein a ratio of the cylinder diameter to the cylinder length is preferably between approximately 0.5 and 3. The device is preferably constructed of plastic foam or flexible plastic inflatable with pressurized air.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
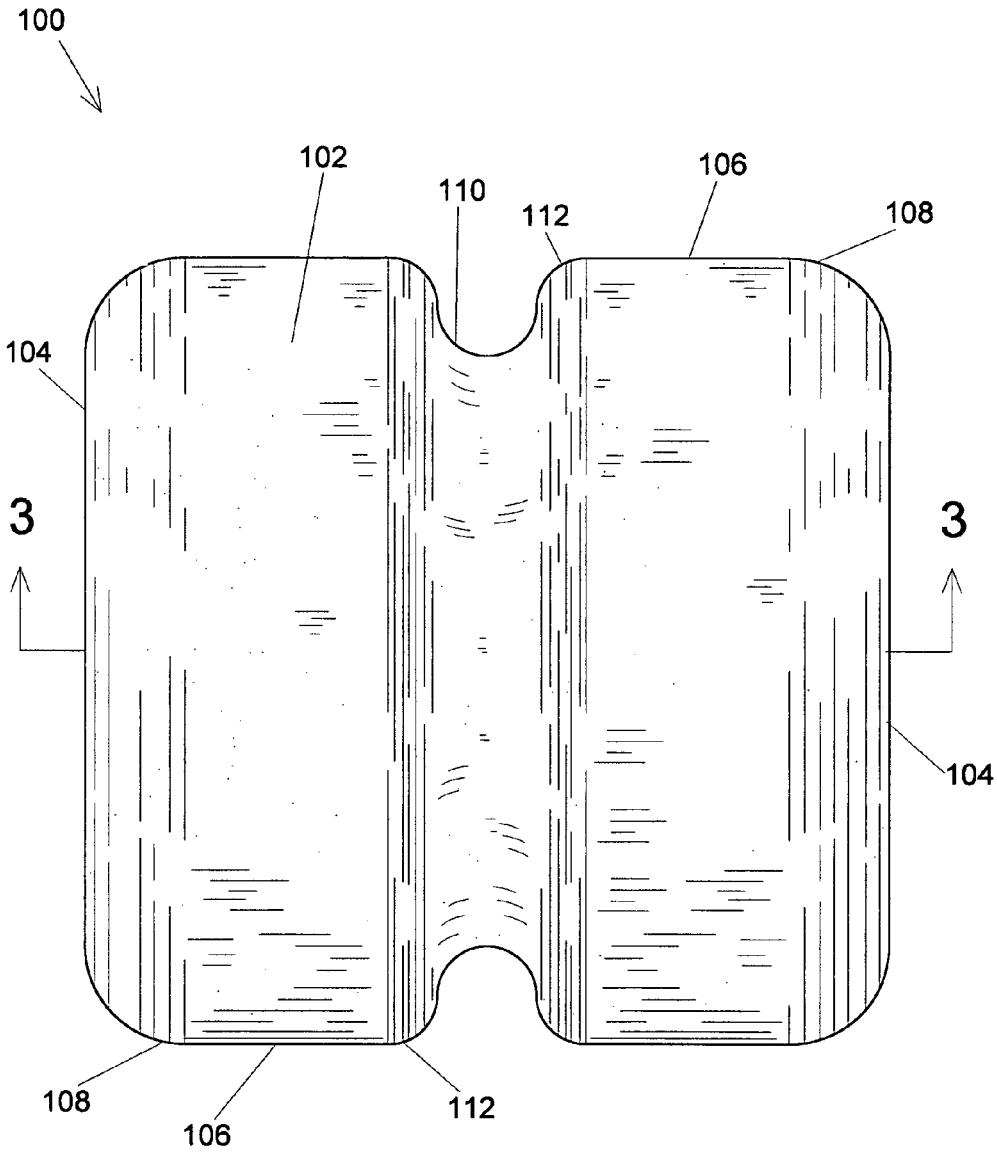
FIG. 1 illustrates a font elevation view of the preferred embodiment of the present invention, the rear elevation view, the top elevation view, and the bottom elevation view being identical thereto.

The currently preferred embodiment 100 of the present invention is illustrated in FIG. 1. The preferred embodiment is a device for facilitating convenient and effective back mobilization of a clothed person. The device comprises a substantially cylindrical body 102 having two ends 104, and two cylindrical, cylindrical, radial surfaces 106. The cylindrical, cylindrical, radial surfaces make substantially smooth transitions 108 into the ends proximate the cylindrical, cylindrical, radial surfaces.

The device further comprises a channel 110 of reduced radius approximately centered between the ends of the cylindrical body. The cylindrical, radial surfaces make substantially smooth transitions 112 into the channel proximate the cylindrical, cylindrical, radial surfaces.

Figure 2:
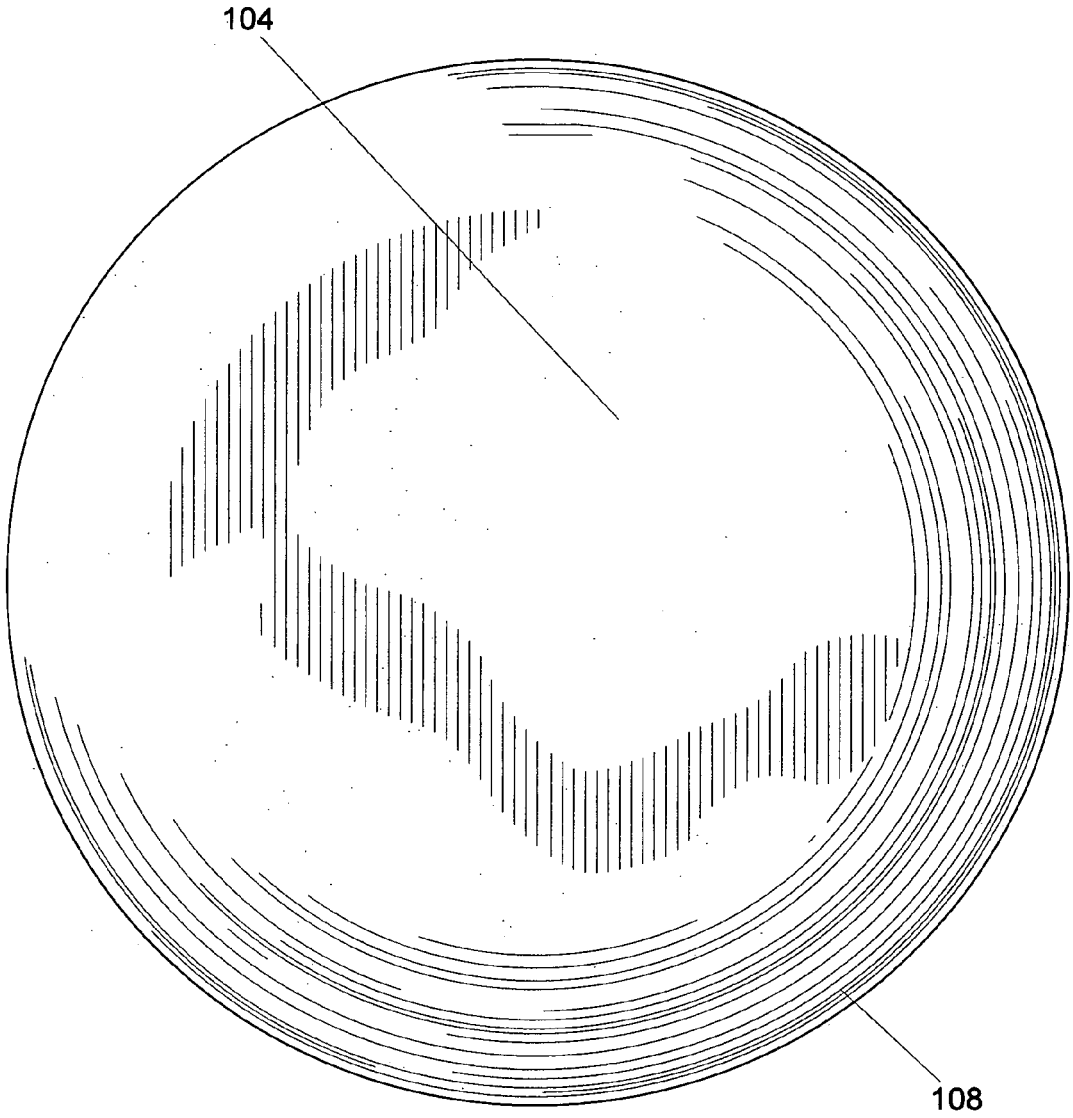
FIG. 2 illustrates a side elevation view of the preferred embodiment of the present invention, the opposite side elevation view being identical thereto.
Figure 3:
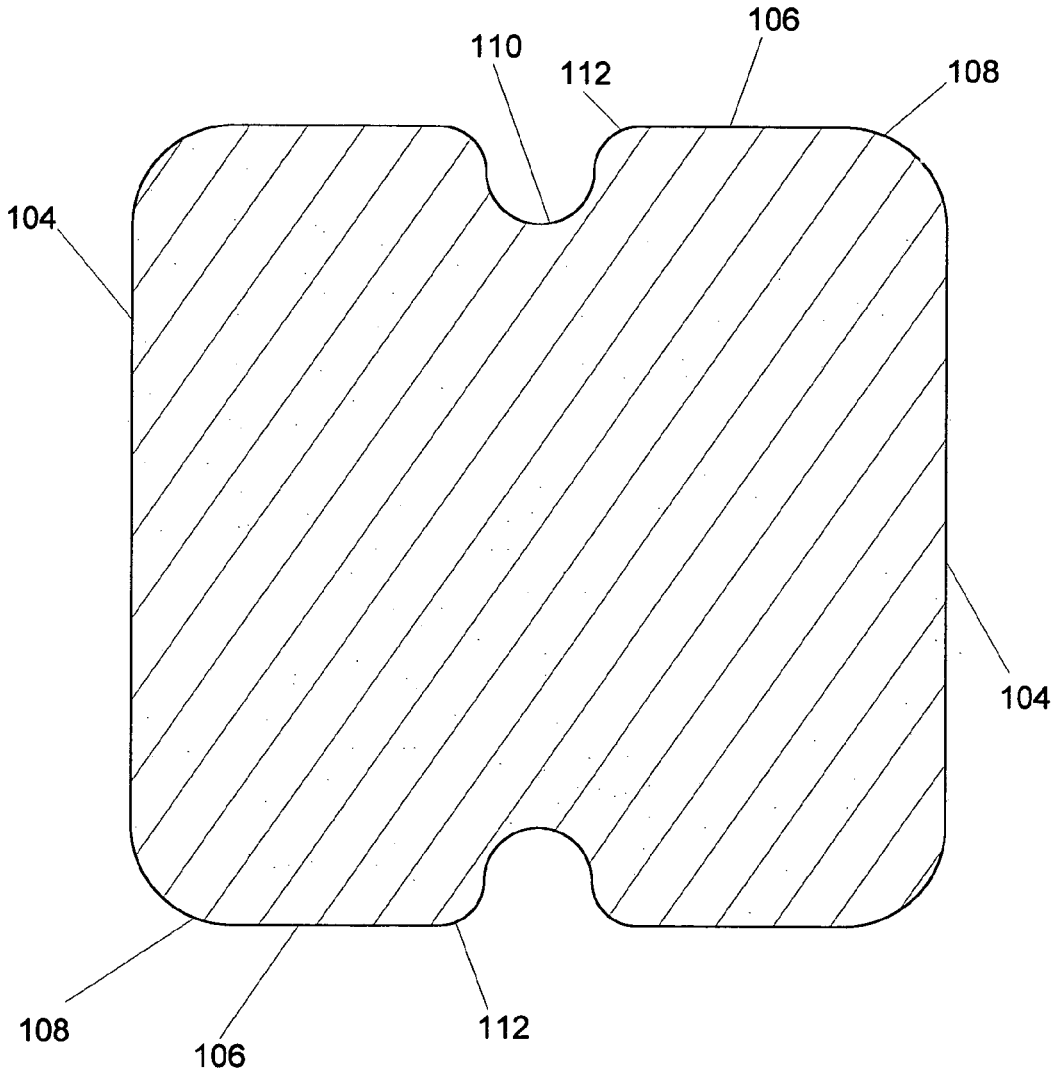
FIG. 3 shows a sectional view of FIG. 1.

FIG. 2 shows a side view of the device of FIG. 1. FIG. 3 shows a sectional view of the device of FIG. 1. The section of FIG. 3 can be revolved about a level line through its center of area to form the device of FIG. 1.

The device has a cylinder length measured between the two ends and a cylinder diameter. The ratio of the cylinder diameter to the cylinder length has been favorably tested between approximately 0.5 and 3 with the currently preferred ratio approximately 1. The preferred length allows the device to move between the shoulders of a user's back without disengaging the back in favor of the shoulder blades. The length has been tested favorably between approximately 10.2 and 20.4 cm (between approximately 4 and 8 inches) with the currently preferred length being approximately 15.24 cm (approximately 6 inches). The combined width of the cylindrical, cylindrical, radial surfaces has been tested favorably between approximately 3.81 and 15.24 cm (between approximately 1.5 and 6 inches) with the currently preferred combined width being approximately 7.62 cm (approximately 3 inches).

Examples of suitable material or materials used for constructing the preferred embodiment include rubbers, plastics, and foams. The currently preferred material for the preferred embodiment is plastic foam, for example laminated EVA foam. The EVA foam can be shaped using common foam manufacturing techniques including laminating, molding, die-cutting and grinding. Also, the cylindrical surface of the foam can be densified by heat molding to improve durability.

The device can be solid as show in FIG. 3 or the device can be hollow or partially hollow. For example, the device can be constructed of an inflatable plastic having an interior that can be filled with pressurized air.

It is very important to note that the preferred embodiment has special, predetermined manufacturing characteristics as described below.

Molding costs can be prohibitive to bringing a new product to market. Therefore, the preferred embodiment has special, predetermined manufacturing characteristics that allow one to readily manufacture the device with relatively low-cost, commercially available products.

Commercially available foam cylinders can be purchased and easily cut to length using a knife and a wooden miter box. The cylinders can then be shaped using an ordinary router and router bits such as ordinary round-over bits and grooving bits. A wooden jig can be constructed to hold the router in place and guide the cut pieces of foam cylinder during routing operations.

Thus, the preferred embodiment of the present invention allows one to begin production in a relatively low-cost manner. This allows one to demonstrate the commercial potential of the preferred embodiment before funding for molding is sought.

The importance of these inherent characteristics of the preferred embodiment is noted herein considering many fine inventions are never able to be appreciated by consumers due to prohibitive molding costs and the like.

Figure 4:
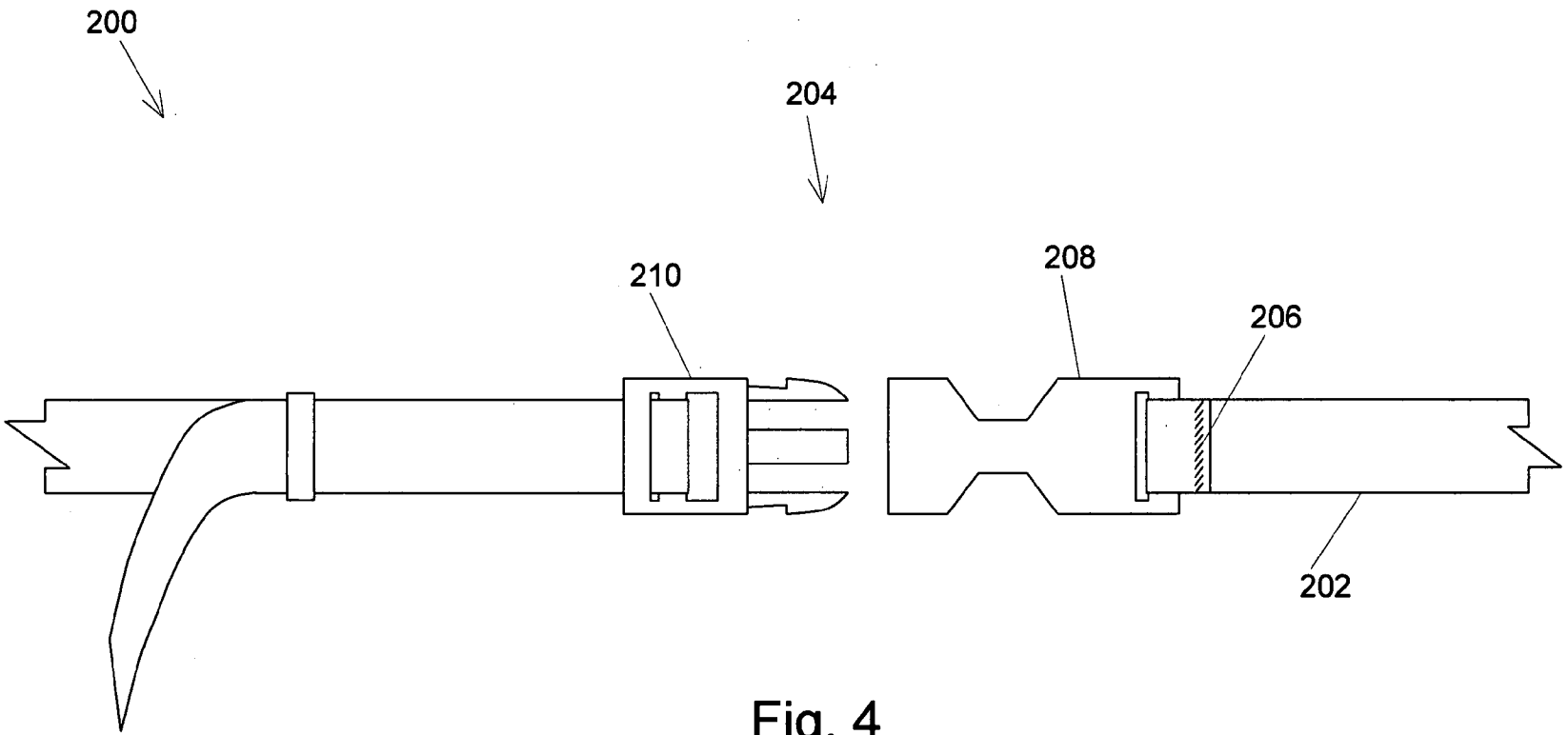
FIG. 4 illustrates an elastic strap having an adjustable, quick-release buckle.

As illustrated in FIG. 4, the preferred embodiment also includes a clothing retainer means 200 for retaining the user's clothing proximate the body of the user of the device. The clothing retainer means may be embodied as an elastic strap 202 coupled to an adjustable, quick-release buckle 204. As illustrated in FIG. 4, the elastic strap is sewn 206 onto the female part 208 of the quick-release buckle. The elastic strap is then adjustably connected to the male part 210 of the quick release buckle.

The clothing retainer means may be any system that allows a user to retain the user's clothing proximate the body of the user. Thus, the clothing retainer means may be embodied in many alternative ways including as an elastic strap having a hook-and-loop fastening system sewn thereon to allow the elastic strap to be adjustably secured to the user's body.

Figure 5:
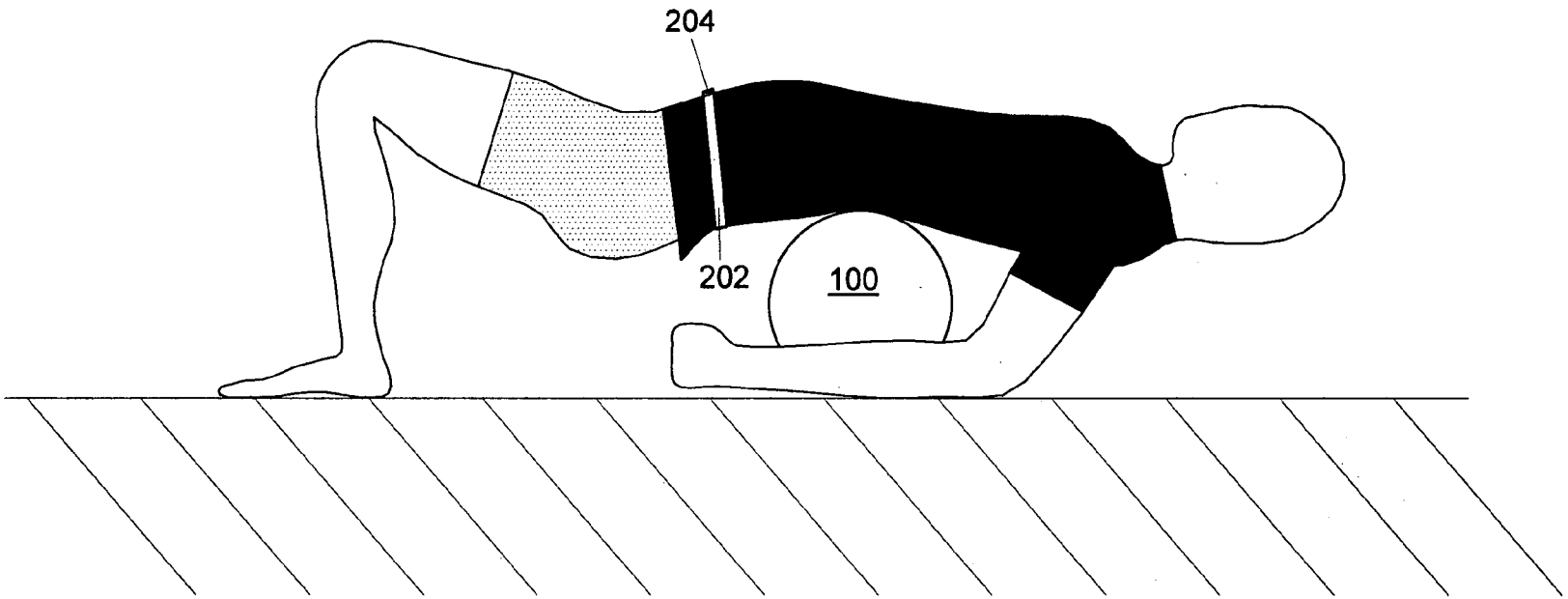
FIG. 5 shows a view of a clothed person using the preferred embodiment of the present invention to mobilize their back.
Figure 6:
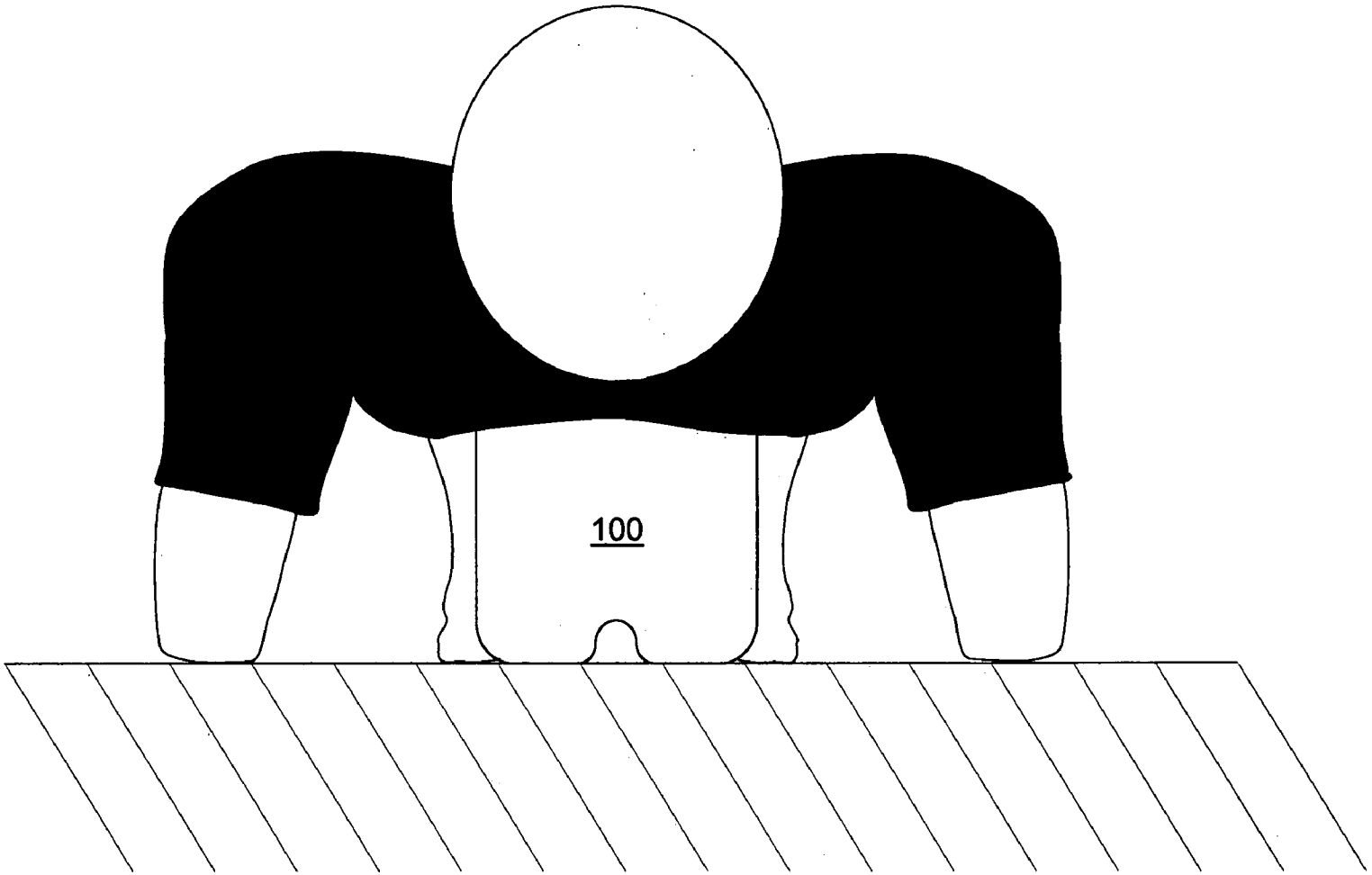
FIG. 6 shows another view of the clothed person of FIG. 5 using the preferred embodiment of the present invention to mobilize their back.

FIGS. 5 and 6 show a person using the preferred embodiment of the present invention. The person secures the elastic strap around his or her shirt in a advantageous location using the adjustable buckle. Then, the person places the device between his or her back and a floor. The person then gently arches his or her back over the device and relaxes the back muscles. This gentle arching and associated relaxation is done according the degree of tolerance and according to the current degree of mobilization of the user. Individual vertebra and muscle groups can thus be mobilized and stretched. This process is can be repeated as the user rolls the device from the top of the buttocks to the base of the neck to mobilize the user's back. The user can also target any desired area of stiffness. Other therapeutic movements are possible such as gentle twisting of the users body.

By transferring weight to and from the user's arms and feet as possible, the user's arms and feet can be used to vary the pressure applied to the back from the device as needed.

The device can also be used against a wall instead of a floor. This allows lighter pressure to be applied to the back.

The elastic strap and buckle allow the user to retain his or her shirt to his or her body during use of the device. Without the strap and buckle, the user's shirt may be caught under the device as it rolls, thus impeding continued use of the device and also causing stretching the shirt.

Important performance characteristics of the device are noted herein. First, due to the profile of the device, no creases and the like are created in the users clothing during use of the device. Next, due to the elastic strap and buckle, the user's shirt does not catch and subsequently stretch during use of the device. Next, due to the inherent characteristics of the device such as the width and ends, the device adequately engages the back when used near the shoulders. Next, due to the radial, cylindrical surface, the device exhibits axial stability when used on common floor coverings such as various carpets. Next, due to the radial, cylindrical surface, the device exhibits roll path stability when used on common floor coverings such as various carpets. Next, due to its unique combination of characteristics, the device can effectively mobilize the back from the top of the buttocks to the base of the neck. Next, due to its unique combination of characteristics, the device can eliminate excessive pressure on the back during use. Next, due to its groove characteristics, the device does not apply high pressure directly to the spine and its associated soft tissues. Next, due to its material and shape characteristics, the device has no rigid parts proximate and thus potentially contacting sensitive back areas. Next, due to its unique combination of shape and material characteristics, the device has no rigid edges that movably contact sensitive areas of the body at high pressures and without visibility during use. Next, due to its shape characteristics, the device has no sharp edges that movably contact sensitive areas of the body at high pressures and without visibility during use. Finally, the device has been invented and optimized solely for the purpose of facilitating the convenient and effective mobilization of the back of a clothed person, and, therefore does not suffer from necessary compromises made to expand the usefulness of the device to multiple areas of the body or multiple purposes.

Figure 7:
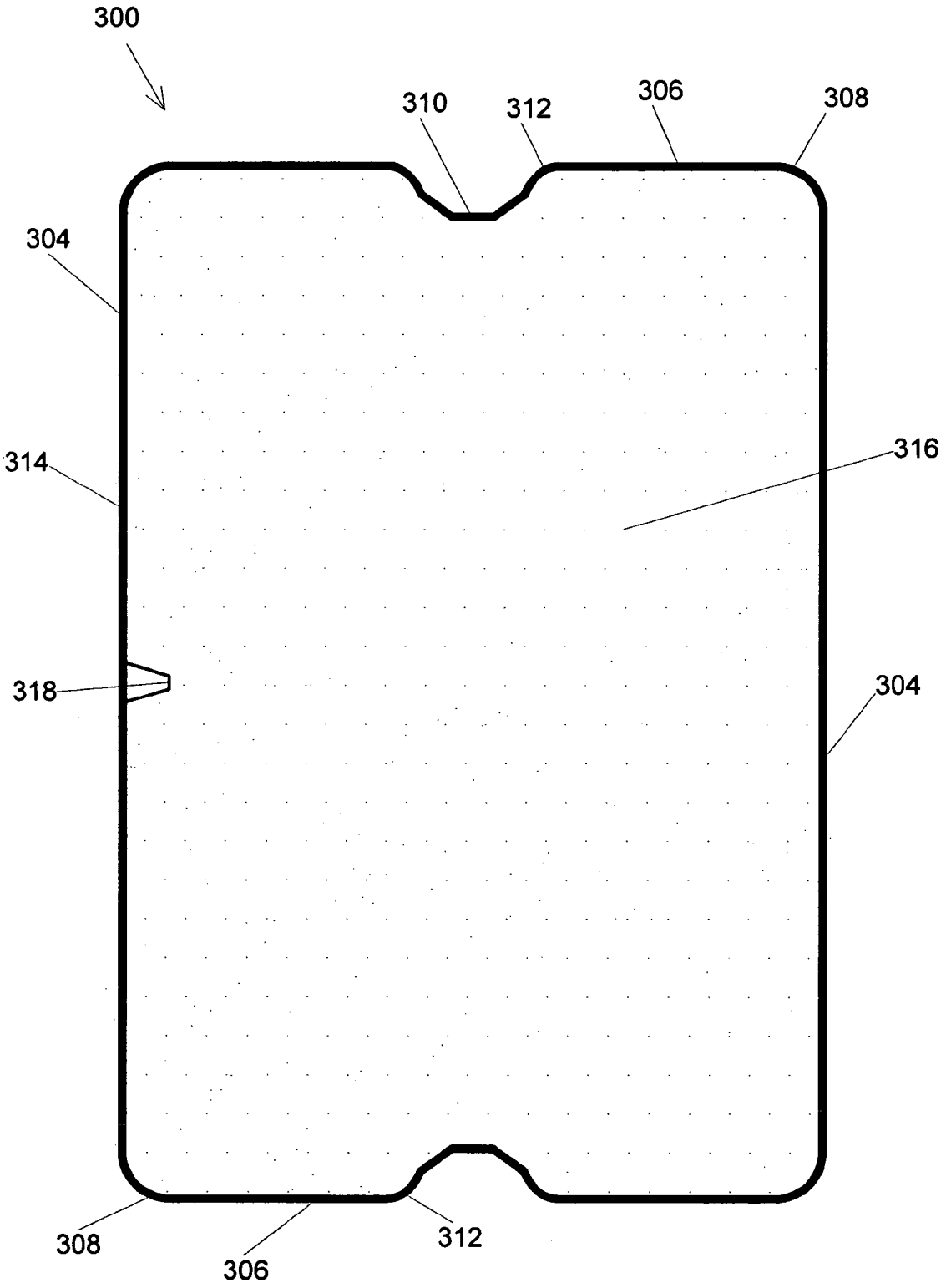
FIG. 7 shows a sectional view demonstrating one of many alternative embodiments of the present invention.

In general, devices and systems consistent with the present invention provide an improved device and system for mobilizing the back of a clothed person. The above detailed description enables one skilled in the art of the present invention to make, use, and thus experience the novel benefits of the present invention. It will be apparent to one skilled in the art that other embodiments, modifications, and variations consistent with the present invention are possible, and that practicing the teachings of the present invention provided herein shall yield still further embodiments, modifications, and variations of the present invention. For example, FIG. 7 shows a sectional view demonstrating one of many possible alternative embodiments 300 of the present invention. In this alternative embodiment, the shape of the channel 310 has been changed from the preferred shape illustrated in FIG. 3 to another shape. The substantially smooth transition 308 from the cylindrical, cylindrical, radial surfaces 306 to the ends 304 has also been lessened in radius from the preferred embodiment illustrated in FIG. 1. The substantially smooth transition 312 from the cylindrical, cylindrical, radial surfaces 306 to the channel 310 has also been changed.

Furthermore, the ratio of the cylinder diameter to the cylinder length can be changed from the preferred ratio of approximately 1. This is illustrated in FIG. 7 where the ratio has been increased to approximately 1.5.

Furthermore, as shown in the sectional view of FIG. 7 this alternative embodiment is constructed of flexible plastic 314 of the type that can be inflated with pressurized air 316 through a self-sealing inflation valve 318.

Thus, as one can easily see, although the description above contains many specificities, these should not be construed as limiting the scope of the present invention but as merely providing illustrations of the presently preferred embodiment of the present invention. It is therefore critical that the scope of the present invention should be defined strictly by the appended claims and their equivalents.

What is claimed is:

1. A device for facilitating convenient and effective back mobilization of a clothed person, the device comprising:

a substantially cylindrical body having two ends and two cylindrical, radial surfaces, wherein the cylindrical, radial surfaces make substantially smooth transitions into the ends proximate the cylindrical, radial surfaces; and a channel of reduced radius approximately centered between the ends of the cylindrical body, wherein the cylindrical, radial surfaces make substantially smooth transitions into the channel proximate the cylindrical, radial surfaces said device having a cylinder length measured between the two ends and a cylinder diameter, wherein a ratio of the cylinder diameter to the cylinder length is between approximately 0.5 and 3.

2. The device of claim 1 wherein the device is constructed of plastic foam.

3. The device of claim 1 wherein the device is constructed of flexible plastic inflatable with pressurized air.

4. A system for facilitating convenient and effective back mobilization of a clothed person having a body, the system comprising:

a device for facilitating convenient and effective back mobilization of a clothed person, the device comprising:

a substantially cylindrical body having two ends and two cylindrical, radial surfaces, wherein the cylindrical, radial surfaces make substantially smooth transitions into the ends proximate the cylindrical, radial surfaces; and a channel of reduced radius approximately centered between the ends of the cylindrical body, wherein the cylindrical, radial surfaces make substantially smooth transitions into the channel proximate the cylindrical, radial surfaces; and clothing retainer means for retaining the clothing proximate the body of the person;

wherein the person is able to mobilize the back while moving the back along the cylindrical, radial surfaces of the device causing the device to roll while the retainer means keeps the clothing from underneath the rolling device as it rolls.

5. The system of claim 4 wherein the device has a cylinder length measured between the two ends and a cylinder diameter, wherein a ratio of the cylinder diameter to the cylinder length is between approximately 0.5 and 3.

6. The system of claim 5 wherein the device is constructed of plastic foam.

7. The device of claim 5 wherein the device is constructed of flexible plastic inflatable with pressurized air.

* * * * *